US009873972B2

(12) United States Patent
Butterworth, III

(10) Patent No.: US 9,873,972 B2
(45) **Date of Patent: *Jan. 23, 2018**

(54) LAUNDRY RECIRCULATION AND FILTRATION SYSTEM

(71) Applicant: Butterworth Industries, Inc., Gas City, IN (US)

(72) Inventor: Frank L. Butterworth, III, Upland, IN (US)

(73) Assignee: Butterworth Industries, Inc., Gas City, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/451,996

(22) Filed: Mar. 7, 2017

(65) Prior Publication Data

US 2017/0175318 A1 Jun. 22, 2017

Related U.S. Application Data

(63) Continuation of application No. 14/545,663, filed on Jun. 3, 2015.

(60) Provisional application No. 61/997,518, filed on Jun. 3, 2014.

(51) Int. Cl.
*D06F 39/08* (2006.01)
*D06F 39/10* (2006.01)

(52) U.S. Cl.
CPC ..... *D06F 39/083* (2013.01); *D06F 39/08* (2013.01); *D06F 39/10* (2013.01)

(58) Field of Classification Search
CPC ..... D06F 39/08; D06F 39/083; D06F 39/10; D06F 35/00; D06F 35/005; D06F 35/006
See application file for complete search history.

(56) References Cited

U.S. PATENT DOCUMENTS

| | | | |
|---|---|---|---|
| 3,811,300 | A | 5/1974 | Barton et al. |
| 4,211,071 | A | 7/1980 | Wyatt |
| 4,211,650 | A | 7/1980 | Thomas |
| 4,288,978 | A | 9/1981 | Wyatt |

(Continued)

FOREIGN PATENT DOCUMENTS

| | | |
|---|---|---|
| EP | 2 455 533 A1 | 5/2012 |
| JP | 2008 099980 | 5/2008 |

(Continued)

OTHER PUBLICATIONS

International Search Report and Written Opinion for PCT/US2015/000064 dated Dec. 11, 2015.
Machine translation of KR 10-2003-0013173 A, Jul. 6, 2017.

*Primary Examiner* — Joseph L. Perrin
(74) *Attorney, Agent, or Firm* — Womble Bond Dickinson (US) LLP

(57) ABSTRACT

A laundry system may include a washing machine that receives a wash mixture and at least one laundry item to be laundered during a washing operation. The washing machine may wash the at least one laundry item to remove at least one contaminant from the at least one laundry item, with the at least one contaminant being received in the wash mixture. The laundry system also can include an extraction system in communication with the washing machine. The extraction system can have at least one magnet that attracts magnetic or metallic particles from at least part of the wash mixture. The extraction system additionally can include at least one filtration system that filters at least part of the wash mixture during the washing operation.

30 Claims, 4 Drawing Sheets

(56) References Cited

U.S. PATENT DOCUMENTS

| | | | |
|---|---|---|---|
| 4,337,619 | A | 7/1982 | Wyatt |
| 4,418,651 | A | 12/1983 | Wyatt |
| 4,441,460 | A | 4/1984 | Wyatt |
| 4,686,779 | A | 8/1987 | Wyatt et al. |
| 4,704,804 | A | 11/1987 | Wyatt et al. |
| 4,731,938 | A | 3/1988 | White |
| 4,817,518 | A | 4/1989 | Wyatt et al. |
| 4,828,709 | A | 5/1989 | Houser et al. |
| 4,895,136 | A | 1/1990 | Poppe |
| 4,903,414 | A | 2/1990 | White et al. |
| 4,997,549 | A | 3/1991 | Atwood |
| 5,097,556 | A | 3/1992 | Engel et al. |
| 5,501,792 | A | 3/1996 | Carroll, Jr. |
| 5,806,120 | A | 9/1998 | McEachern |
| 5,868,937 | A | 2/1999 | Back et al. |
| 5,876,461 | A | 3/1999 | Racette |
| 6,195,825 | B1 | 3/2001 | Jones |
| 6,269,667 | B1 | 8/2001 | Back |
| 6,287,347 | B1 | 9/2001 | Krack et al. |
| 6,327,731 | B2 | 12/2001 | Back et al. |
| 6,463,940 | B1 | 10/2002 | Thomas et al. |
| 6,474,111 | B1 | 11/2002 | Pattee |
| 6,692,638 | B2 | 2/2004 | Sharkey |
| 7,942,978 | B2 | 5/2011 | Holzman et al. |
| 8,459,275 | B2 | 6/2013 | Smith et al. |
| 8,656,526 | B2 | 2/2014 | Brewin |
| 2002/0162177 | A1 | 11/2002 | Raney |
| 2003/0110815 | A1 | 6/2003 | Poy |
| 2005/0000897 | A1 | 1/2005 | Radomyselski |
| 2005/0017114 | A1 | 1/2005 | Gadini |
| 2005/0022316 | A1 | 2/2005 | Rawson |
| 2005/0056581 | A1 | 3/2005 | Arguello |
| 2005/0252538 | A1 | 11/2005 | Vernon |
| 2013/0213095 | A1 | 8/2013 | Monacchi |
| 2014/0298590 | A1 | 10/2014 | Fulmer |
| 2015/0246377 | A1 | 9/2015 | He |
| 2016/0183763 | A1 | 6/2016 | Li |

FOREIGN PATENT DOCUMENTS

| | | | |
|---|---|---|---|
| KR | 10-2003-0013173 | A | 2/2003 |
| WO | WO 99/46205 | | 9/1999 |
| WO | WO 2014/146165 | A1 | 9/2014 |

LAUNDRY RECIRCULATION AND FILTRATION SYSTEM

CROSS REFERENCE TO RELATED APPLICATION

The present application is a continuation of U.S. patent application Ser. No. 14/545,663, filed Jun. 3, 2015, which claims the benefit of U.S. Provisional Patent Application No. 61/997,518, filed Jun. 3, 2014.

INCORPORATION BY REFERENCE

The disclosures of U.S. patent application Ser. No. 14/545,663, filed Jun. 3, 2015, and U.S. Provisional Patent Application No. 61/997,518, filed Jun. 3, 2014, are both hereby incorporated by reference herein for all purposes as if presented in their entireties.

TECHNICAL FIELD

The present application generally relates to industrial laundry systems, e.g. systems for cleaning and/or treating various textiles and textile products.

BACKGROUND

FIG. 1 illustrates a "wet cleaning" or laundry processes 10 that utilizes water to clean or launder a wide variety of materials, including specifically textiles, namely commercial textile products, woven and non-woven fabrics, linens and knits, as typically known or practiced in the art of textiles and industrial textile cleaning. By way of example, the various types of laundered textiles can include clothing, gloves, equipment covers, wipers, towels, rags, filters, sleeves, gauntlets, capes, hoods, booties, boots, shoe covers, aprons, frocks, coveralls, suits, shirts, pants, lab coats, bedding or gurney sheets, drapes, mops or mop heads, commercial floor mats or walk-off mats, table cloths, napkins, and the like. In addition, the sources for the textiles that require laundering can include, but are not limited to, the healthcare, industrial, retail and hospitality industries.

As shown, a laundry process 10 generally utilizes water (e.g., from a municipal water source 20) that has been heated 24 (this step is typical, but optional) prior to introduction into a washing machine 30 that contains soiled textiles. The water is generally introduced into the washing machine 30 at pre-determined temperatures during the various stages or segments of a washing cycle, such as during a pre-wash stage, a break stage, a carry-over stage, a rinse stage, and the like. At some point in the washing cycle one or more chemical agents 40 or detergents are combined with the water in the washing machine, especially during the break stage, to form a wash or break bath in the washing machine 30. The washing machine is then operated to agitate the textiles within the break bath to loosen and remove the foreign material from the textile surfaces. The break stage is often followed by one or more rinse stages in which additional chemistry can be added to the rinse water bath to further clean or treat the washed articles.

The wash water with suspended contaminants is then disposed (e.g., into a laundry water recovery system or the municipal sewer system 50) for laundry water or heat recovery and reuse, and/or eventual processing at a waste water treatment plant. In addition, in some cases a water softening or water purification treatment 22 is applied to the municipal water to prior to heating 24 to reduce the build up of hard water scale within the heater and to improve the effectiveness of the chemical agents or detergents in the cleaning process.

Despite the broad acceptance of the wet cleaning processes 10 detailed in FIG. 1, certain drawbacks and disadvantages remain. For example, textiles that are washed in a typical laundry process often undergo abrasion and degradation that shortens their useful life. In addition, treatments that include the use of strong chemicals, including but not limited to nonylphenol ethoxylates (NPE's), are often required to clean adequately articles that have been heavily soiled. A need therefore exists for a wet cleaning or laundry process that is more effective in cleaning and less damaging to the textiles that are being washed, and that also allows for the use of chemical treatments that may be more environmentally friendly, or "green". It is to the provision of such a wet cleaning or laundry process that addresses these and other needs that the present disclosure is primarily directed.

SUMMARY

Briefly described, a recirculation and filtration system receives a stream of contaminated wash water withdrawn from a washing machine during one or more pre-wash, break, or rinse stages in a washing cycle, filters the wash water to remove metallic particle, non-metallic particles such as suspended solids, dissolved solids, and other impurities, and delivers a return stream of cleaned (filtered) wash water to the washing machine. The continuous, closed loop recirculation and filtration of the wash water provides a dynamic water exchange that maintains the wash water in the washing machine, such as in a pre-wash bath, a break bath or a rinse bath, in an improved state of cleanliness that is beneficial for extracting and capturing foreign material and contaminants from the textile surface, for improving the effectiveness of the wash cycle stage, and for reducing abrasive wear on the textiles caused by the agitation of the washing machine.

Those skilled in the art will appreciate various advantages and benefits of various embodiments of the present invention upon reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION

Figure 1:
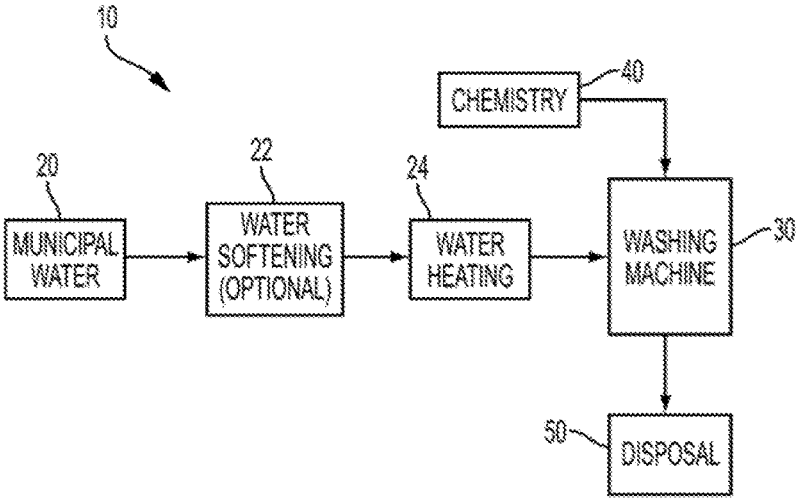
FIG. 1 PRIOR ART
FIG. 1 is a block diagram of an industrial washing process as generally known in the prior art.

The present disclosure relates to a recirculation and filtration system that can be combined with the industrial laundry processes described above to better clean textiles and to preserve the textiles from the incidental wear and damage that can often occur during the washing process. In one embodiment of the disclosure shown in FIG. 2, the washing machine 130 in the laundry process 100 can include a soil constituent extraction/removal (SCE) system 134 that receives a withdrawn amount or stream 132 of contaminated wash water from the washing machine 130 during one or more stages or segments of a washing cycle, filters the wash water to remove metallic particle, non-metallic particles such as suspended solids, dissolved solids, and other impurities, and then outputs a return stream 136 of cleaned wash water to the washing machine 130. The continuous closed loop recirculation of the wash water throughout the various segments of the washing cycle can provide for a dynamic water exchange that maintains the wash water in the washing machine, or break bath, in an improved state of cleanliness.

As understood by one of skill in the art, a washing cycle or washing profile in an industrial laundry process can often include a plurality of wash stages or segments that are sequentially ordered to enhance the cleaning of the articles that are being washed. For example, a washing cycle can often include a pre-wash stage, a break stage, a carry-over stage, and a plurality of rinse stages, with both the temperature of the water and any added chemistry being controlled create a wash water bath that best performs a function at that particular stage in the washing cycle. Furthermore, the sequence, temperature and chemistry of each wash stage in a washing cycle may also be tailored for particular fabrics or soiling conditions to create customized washing profiles that are optimized to clean those particular textile articles or remove a particular type of contaminant.

Filtering wash water in the washing machine 130 can be advantageous for extracting and capturing foreign material and contaminants from the textiles and for improving the effectiveness of the wash cycle. For instance, immediately removing the contaminants from the wash water with the SCE system 134, such as during the break stage, can substantially reduce the re-deposition of the contaminant materials, such as suspended solids or dissolved solids, onto the surface of another article. In addition, immediately removing hard particulate contaminants, such as metallic dust, non-metallic dust, industrial shavings, solid particles, and the like, can also substantially reduce any abrasion on the textiles resulting from rubbing contact on the individual strands of yarn, filaments, or other textile constituent fibers during agitation of the washing machine.

Figure 2:
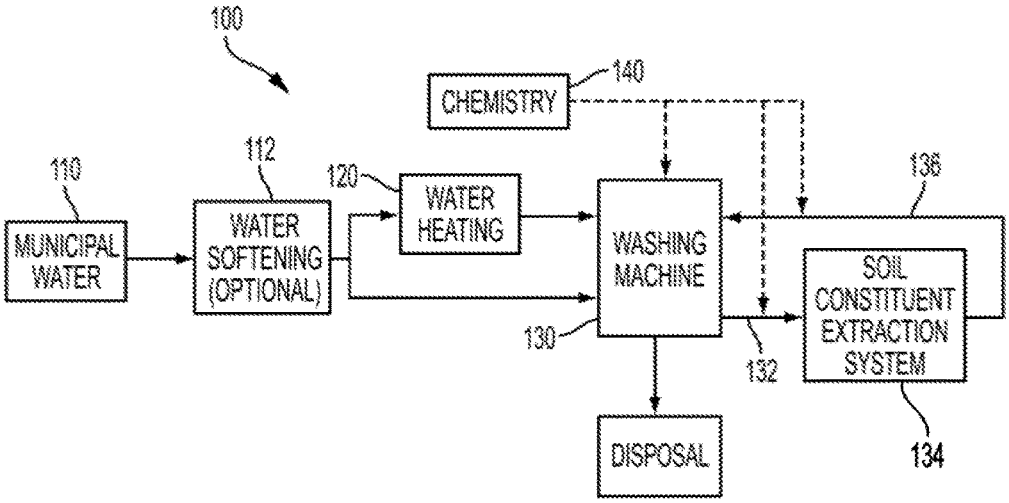
FIG. 2 is a block diagram of an industrial washing process in accordance with one representative embodiment of the present disclosure

Also shown in FIG. 2, one or more chemicals 140 or chemical agents, including but not limited to detergents, solvents, PH boosters, PH reducers, softening agents, antimicrobial agents, and the like, can be combined with the water in the washing machine during the various stages of the washing cycle to create a pre-wash bath, a break bath, or a rinse bath that best performs a function at that particular stage in the washing cycle. In one aspect, the enhanced cleanliness of the wash water provided by the soil constituent extraction system 134 can further allow for the use of "green" chemistry or detergents having a reduced impact on the environment, but which otherwise may be considered less effective for cleaning in traditional industrial washing processes in which the wash water becomes progressively more contaminated such as, for example, during the break stage.

Figure 3:
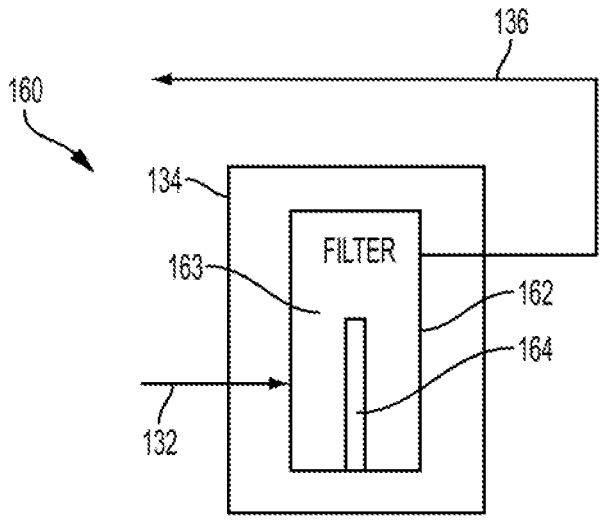
FIG. 3 is a block diagram of a soil constituent extraction system, in accordance with another representative embodiment.

One exemplary embodiment 160 of the soil constituent extraction system 134 is illustrated in FIG. 3, in which a single filter 162 is used to clean the withdrawn stream 132 of contaminated wash water. In one aspect the filter 162 can include any type of filter, e.g., a porous or fibrous filtration media 163, which removes particles and impurities at or above a predetermined size range, such as those particles that are greater than or about 25 micrometers in diameter or greater than or about 5 micrometers in diameter, for example. In addition to capturing the suspended solid particles, the filtration media 163 can also be absorbent to and capture dissolved solids, oils, and other hydrocarbon-based impurities.

The filter 162 of the SCE system 160 of FIG. 3 can also include one or more magnets 164 for attracting and capturing magnetic or ferrous metallic particles from the contaminated wash water. As these metallic particles can be larger than many other types of suspended soil particles in the contaminated wash water, the filter 162 can be configured so that the withdrawn wash water stream 132 encounters the magnet 164 early in the filtration process. This can facilitate the capture and removal of metallic particles prior to encountering the filtration media 163, thereby preventing premature saturation of the filtration media 163 with contaminates that would require maintenance or replacement.

Figure 4:
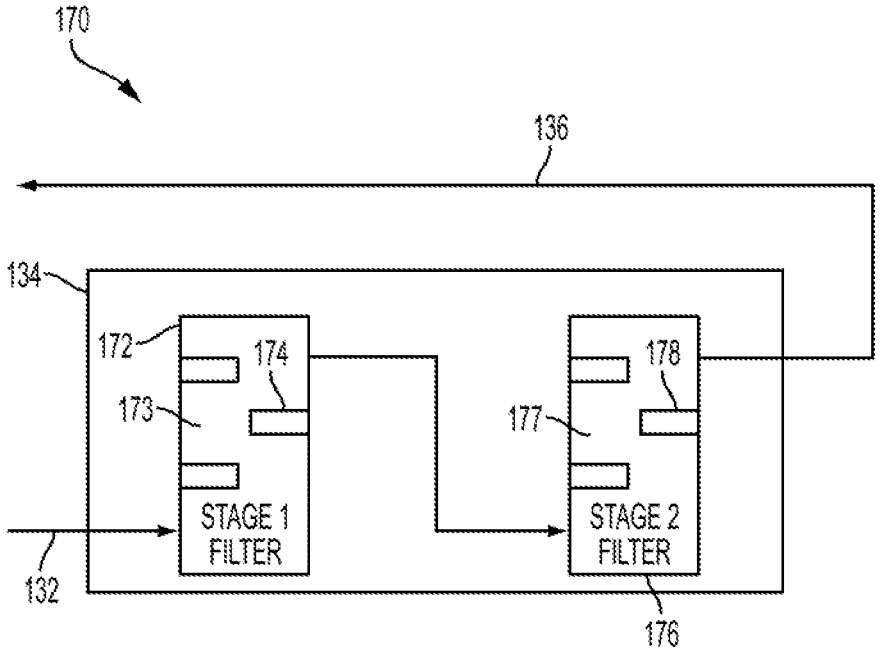
FIG. 4 is a block diagram of a soil constituent extraction system, in accordance with yet another representative embodiment.

Another embodiment 170 of the soil constituent extraction system 134 having a first stage filter 172 and a separate second stage filter 176 is illustrated in FIG. 4. In this configuration, the first stage filter 172 can be provided with a coarser filtration media 173 configured to remove substantially all of the larger non-magnetic particles and impurities (e.g. those that are greater than or about 25 micrometers in diameter), and, optionally, one or more magnets 174 for capturing the metallic contaminants. The second stage filter 176 can be provided with fine filtration media 177 configured to remove substantially all of the remaining particles and impurities (e.g. those that are greater than or about 5 micrometers in diameter). As the fine filtration media 177 generally are more expensive than coarser filtration media 173, staging the filters may provide for a more efficient and economical configuration that reduces the cost of operating, maintenance, and replacement. In one aspect the second stage filter 176 can also be provided with one or more magnets 178 for capturing any magnetic material that was not captured in the first stage.

In addition, it is to be appreciated that additional stages and types of filtration or treatment of the wash water in the SCE system, including make-up heating and the addition of additives, are also possible and may be considered to fall within the scope of the present disclosure. For example, the SCE system could include three or more filtration vessels or stages, or the filtering could be performed by self-cleaning-type filters as well as disposable media-type filters. In addition, two SCE systems could also be installed to a single washing machine with a programmable control valve that directs the withdrawn wash water to a selected SCE system depending on, for example, the stage of the washing cycle or the type of textile articles in the washing system.

Figure 5:
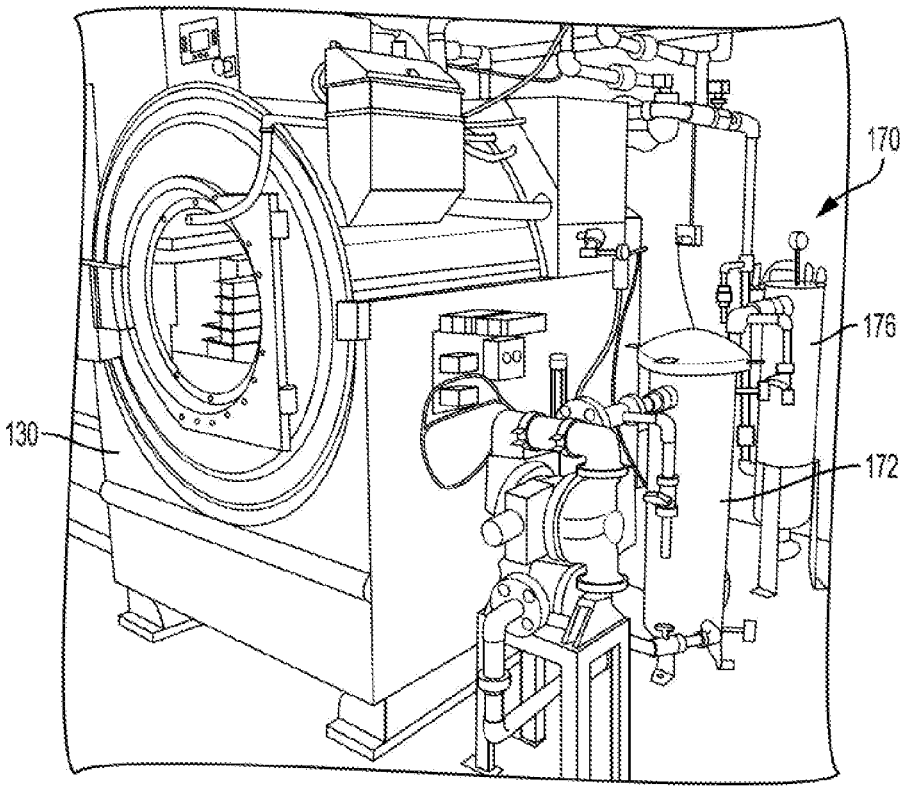
FIG. 5 is an exemplary rendering of an industrial washing machine in combination with the soil constituent extraction system of FIG. 4.

FIG. 5 is a picture of an exemplary industrial washing machine 130 that has been combined with the soil constituent extraction system 170 illustrated in FIG. 4 having a first stage filter 172 and a second stage filter 176. Although not visible within its casing, the first stage filter 172 can include a magnet described above. Both filters 172, 176 can be isolated from the closed loop recirculation of the soil constituent extraction system 170 with valves and drained for individual maintenance or replacement of the filter media, as the rate at which the two filters become saturated with contaminants can vary independently. The soil constituent extraction system 170 can further include a variety of sensors (e.g. temperature, pressure, flow rate, etc.), control valves, actuators, and electronic control devices (e.g. a programmable logic controller (PLC) or similar processor-based controller) that control the operation of the SCE system 170 during the various washing stages (e.g. pre-wash stage, break stage, rinse stage) of the washing machine. The control system can also be configured to optimize the flow rate of the withdrawn stream 132 of contaminated wash water (e.g. pre-wash water, break water, rinse water) to maintain the bath within the washing machine 130 to a preferred degree of cleanliness.

Figure 6:
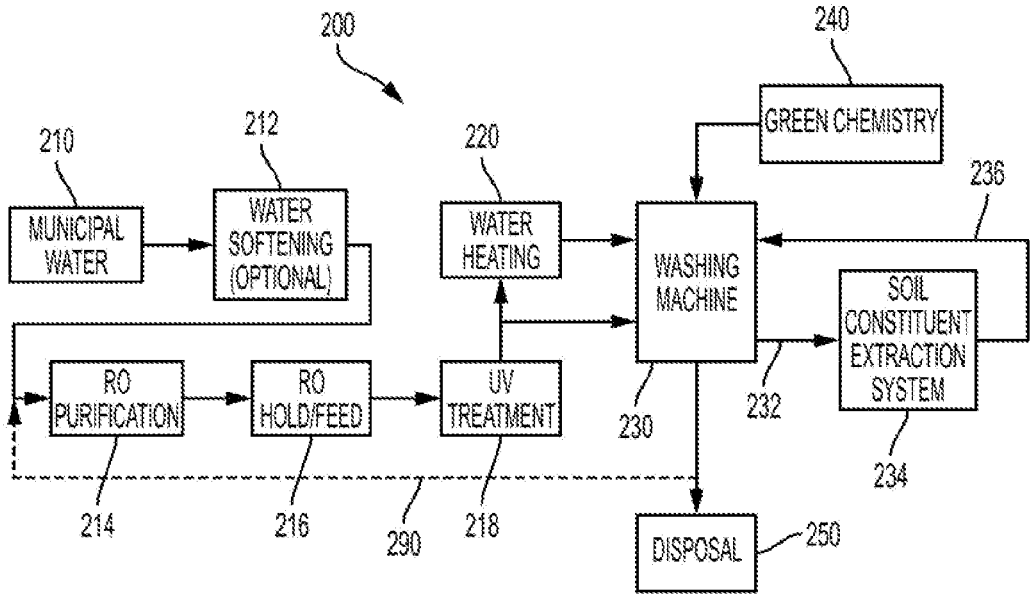
FIG. 6 is a block diagram of an industrial washing process, in accordance with yet another representative embodiment of the present disclosure.

In another embodiment of the disclosure shown in FIG. 6, the industrial laundry process 200 can include a variety of water pre-treatment stages or steps in addition to soil constituent extraction (SCE) system 234. These pre-treatment stages can further treat and purify the water from the municipal water source 210 before it is directed into the heater 220 and the washing machine 230, and provide the initial volume of wash water with a "higher" level of cleanliness that, in turn, can improve the capacity of the industrial laundry process 200 for extracting and capturing foreign material and contaminants from the textile surfaces. As stated above, the enhanced cleanliness of the wash water can also reduce the incidental wear and damage on the washed textiles that is caused by the washing process or that is caused by interaction of the textile with impurities in the water, e.g. those removed from the textile or other textiles being laundered.

One of the pre-treatment steps may comprise reverse osmosis (RO) purification 214 along with a RO hold/feed tank 216. As known to one of skill in the art, RO purification 214 entails a constant but typically slow diffusion of the water through a semi-permeable membrane that can, in one aspect, purify the water to medical grade or pharmaceutical standards by removing substantially all of the salts, metal ions and other contaminants, etc. that are initially present in the municipal water. As the RO purification rate is generally slow, the hold/feed tank 216 may be required to build up a volume of purified water sufficient to fill the washing machine 230 prior to initiation of the laundry process.

Another pre-treatment step can comprise subjecting the wash water or purified RO water to ultraviolet (UV) radiation 218 that kills any remaining small and active organic molecules, such as bacteria and viruses, which may still be present in the water. The highly purified water can then be heated in a water heater 220 prior to being directed into the washing machine 230.

As may be appreciated by one of skill in the art, starting a pre-wash stage, break stage, or rinse stage in the washing machine 230 with highly purified water can reduce the load of contaminants that must be removed in the SCE system 234, thereby making it easier to maintain the bath at a high level of cleanliness during the various stages of the washing cycle. As discussed above, elevating the cleanliness of the bath can be advantageous for extracting and capturing contaminant material from the soiled textile surfaces, substantially reducing the re-deposition of the contaminants onto the surfaces of another article, and decreasing abrasion damage cause by contact between hard particulate matter, whether metal or non-metal, and the individual strands of yarn or filaments during agitation of the washing machine.

Because the water bath in the washing machine 230 is maintained at a higher level of cleanliness than the bath in traditional laundry processes, the wash water may generally be considered in better condition for disposal 250 into a municipal sewer system. Nevertheless, in situations where it may be beneficial to reduce the overall consumption of water, in one aspect the industrial laundry process 200 can further include a recycle line 290 that recycles the used wash water back to the RO purification stage 214, such as after the completion of the break cycle or any other stage, as appropriate. Additionally, it can be appreciated that the RO purification system and UV system could be moved or duplicated into loops in the laundry process other than where shown in the figures (e.g. adding an RO or UV cleaning system in the loop comprising the soil constituent extraction system, or elsewhere).

Figure 7:
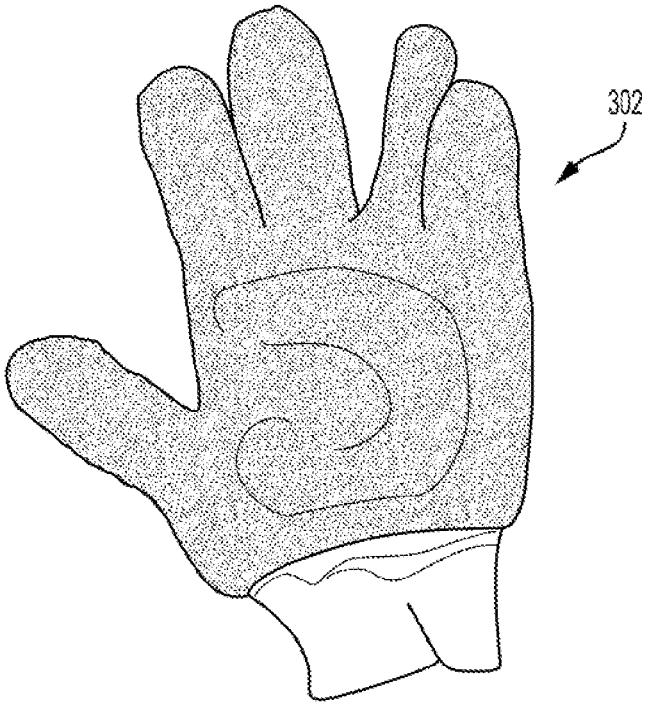
FIG. 7 shows a soiled glove prior to cleaning.
Figure 8:
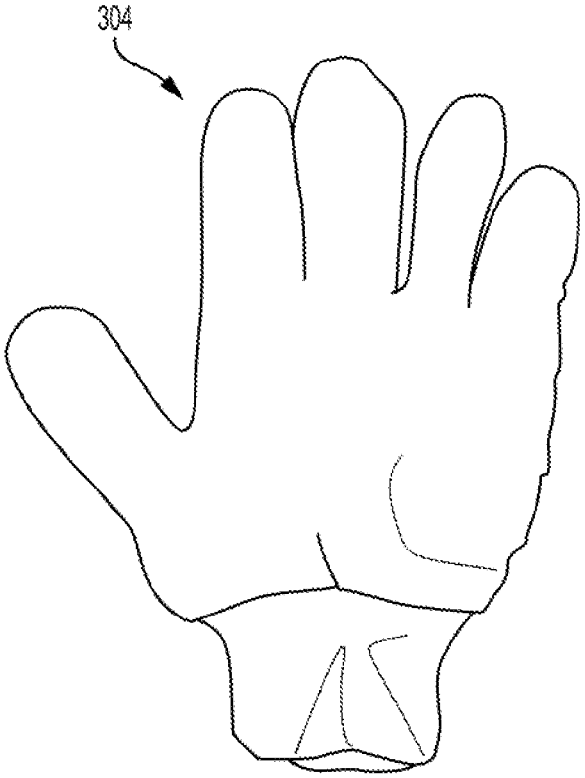
FIG. 8 shows the soiled glove of FIG. 7 after cleaning in an industrial washing process utilizing the soil constituent extraction system of the present disclosure.
Figure 9:
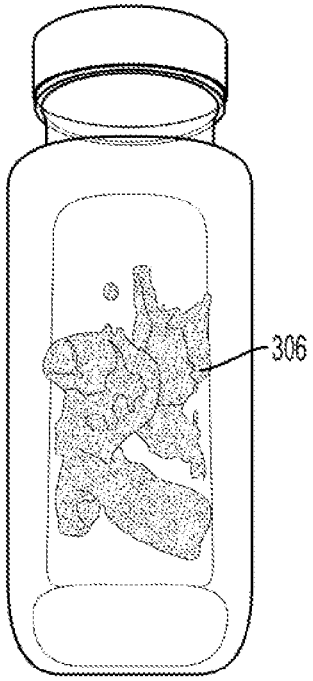
FIG. 9 shows metallic material that has been extracted from soiled textile articles and captured utilizing the soil constituent extraction system of the present disclosure.

FIGS. 7-9 together illustrate the effectiveness of the recirculation and filtration system, or soil constituent extraction system, of the present disclosure. FIG. 7 is a photograph of a glove 302 that has been highly-soiled with metallic and non-metallic particles before cleaning. The same glove is shown in FIG. 8 after washing in an industrial laundry process that includes an SCE system, and illustrates the removal of a substantial amount of particulate matter from the glove. FIG. 9 is representative photograph showing metallic and non-metallic particles that have been extracted and captured from contaminated wash water using an SCE system with a magnet, such as those depicted in FIGS. 3 and 4.

The foregoing description of the disclosure illustrates and describes various embodiments of the present invention. As various changes could be made in the above-described laundry recirculation and filtration system without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments of the present invention that are within the scope of the claims.

Additionally, while the disclosure shows and describes only selected embodiments of the laundry recirculation and filtration system, it will be understood that the present invention further is capable of use in various other combinations and environments, and is capable of various changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A laundry system for extracting metallic or magnetic particles from at least one laundry item, comprising:

at least one washing machine that receives a wash mixture and die at least one laundry item to be laundered during a washing operation, the at least one washing machine washes the at least one laundry item to separate at least one metallic or magnetic contaminant from the at least one laundry item, with the at least one contaminant being received in the wash mixture;

an extraction system in communication with the washing machine, the extraction system receiving at least part of the wash mixture during the washing operation, the extraction system comprising at least one filtration system including at least one filtration stage having at least one filtration medium, the at least part of the wash mixture passes though the at least one filtration medium, and the at least one filtration stage further including at least one magnet that attracts the at least one magnetic or metallic contaminant and facilitates separation of the at least one contaminant from the at least part of the wash mixture to form a filtered wash mixture: and a control system that is configured to control flow of the filtered wash mixture so that, after exiting the extraction system, the filtered wash mixture is provided dynamically to the at least one washing machine during the washing operation.

2. The laundry system of claim 1, wherein, after the extraction system filters the wash mixture to form the filtered wash mixture, at least one chemical agent is added to the filtered wash mixture.

3. The laundry system of claim 1, wherein the at least one filtration system comprises at least one additional filtration stage comprising at least one additional filtration medium, wherein the at least one filtration medium is coarser than the at least one additional filtration medium, and wherein at least one additional magnet is at least partially received in the at least one additional filtration stage of the filtration system.

4. The laundry system of claim 1, wherein the wash mixture comprises water alone, water and a chemical agent, or water and a plurality of chemical agents.

5. The laundry system of claim 1, wherein the extraction system is external to the washing machine.

6. The laundry system of claim 1, wherein the washing operation is any segment of a laundry process chosen from pre-wash, break, carry-over, wash, rinse, or a plurality of rinses.

7. The laundry system of claim 1, further comprising:

a purification stage that purifies at least a portion of the wash mixture before the wash mixture is introduced into the at least one washing machine.

8. The laundry system of claim 1, wherein the control system further comprises one or more sensors configured to monitor one or more aspects of the wash mixture.

9. The laundry system of claim 8, wherein the control system is configured to optimize a flow rate of the at least one portion of the wash mixture extracted to the extraction system based at least in part on an aspect of the wash mixture.

10. The laundry system of claim 9, wherein the aspect of the wash mixture includes a level of cleanliness of the wash mixture.

11. The laundry system of claim 1, further comprising at least one purification stage that purifies at least a portion of the wash mixture before the wash mixture is introduced into the at least one washing machine.

12. A laundry system, comprising:

at least one washing machine that receives a wash mixture and at least one laundry item, the at least one washing machine washes the at least one laundry item in the wash mixture during a washing cycle to separate at least one metallic or magnetic contaminant from the at least one laundry item;

an extraction system that is in communication with the at least one washing machine, the extraction system extracts at least part of the wash mixture and forms a filtered wash mixture that is added to the at least one washing machine during the washing cycle, the extraction system comprises:

a plurality of filtration stages that filter at least part of the wash mixture dynamically during the washing cycle, the plurality of filtration stages each including at least one filtration medium through which the at least part of the wash mixture is passed; and at least one magnet received in one or more of the plurality of filtration stages that for attracting and facilitating capture or retention of the at least one magnetic or metallic contaminant; and a control system comprising a programmable logic controller and one or more sensors that monitor one or more aspects of the wash mixture, wherein the control system is configured to optimize a flow rate of the at least part of the wash mixture extracted by the extraction system based on an aspect of the wash mixture.

13. The laundry system of claim 12, wherein the wash mixture includes water alone, water and a chemical agent, or water and a plurality of chemical agents.

14. The laundry system of claim 13, wherein the plurality of filtration stages includes a first stage with a first filtration medium, and a second stage with a second filtration medium.

15. The laundry system of claim 14, wherein the first filtration medium is coarser than the second filtration medium, and wherein the at least one magnet is at least partially in the first stage of the filtration system.

16. The laundry system of claim 12, further comprising at least one purification stage that purifies at least a portion of the wash mixture before the wash mixture is introduced into the at least one washing machine.

17. An extraction system that receives a wash mixture from a washing machine during a washing operation, the extraction system comprising:

a filtration system comprising a plurality of filtration stages to filter at least part of the wash mixture, each filtration stage of the plurality of filtration stages comprises a filtration medium through which the at least part of the wash mixture is passed to at least partially form a filtered wash mixture;

at least one magnet received in at least one of the plurality of filtration stages that attracts and facilitates capture of magnetic or metallic particles from the at least part of the wash mixture to at least partially form the filtered wash mixture; and a control system configured to dynamically provide the filtered wash mixture to the washing machine during the washing operation, and control the wash mixture received in the extraction system from the washing machine based at least in part on an aspect of the wash mixture in the washing machine.

18. The extraction system of claim 17, wherein the filtration system comprises a first stage comprising a first filtration medium, and a second stage comprising a second filtration medium, wherein the first filtration medium is coarser than the second filtration medium.

19. The extraction system of claim 18, wherein the at least one magnet is in the first stage.

20. The extraction system of claim 19, wherein the second stage includes at least one additional magnet.

21. The extraction system of claim 18, wherein the first filtration medium removes contaminants having a diameter of about 25 micrometers or greater.

22. The extraction system of claim 18, wherein the second filtration medium removes contaminants having a diameter of about 5 micrometers or greater.

23. The extraction system of claim 17, wherein the washing operation is any segment of a laundry process chosen from pre-wash, break, carry-over, wash, rinse, or a plurality of rinses.

24. A filtration system for a washing machine, comprising:

a plurality of filtration stages each receiving a wash mixture from the washing machine, each of the plurality of filtration stages having at least one filtration medium that filters at least part of the wash mixture, wherein each filtration stage of the plurality of filtration stages comprises a filtration medium, with the at least part of the wash mixture passing though the filtration medium to at least partially form a filtered wash mixture;

at least one magnet at least partially in at least one filtration stage of the plurality of filtration stages that attracts metallic or magnetic particles and facilitates separation of the metallic or magnetic particles from the wash mixture to at least partially form the filtered wash mixture; and a control system configured to dynamically provide the filtered wash mixture to the washing machine during the washing operation.

25. The filtration system of claim 24, wherein the plurality of filtration stages comprise a first filtration stage and a second filtration stage.

26. The filtration system of claim 25, wherein the first filtration stage comprises a first filtration medium, and the second filtration stage comprises a second filtration medium, wherein the first filtration medium is coarser than the second filtration medium.

27. The filtration system of claim 26, wherein the first filtration medium removes contaminants having a diameter of about 25 micrometers or greater than 25 micrometers, and the second filtration medium removes contaminants having a diameter of about 5 micrometers or greater than 5 micrometers.

28. The filtration system of claim 26, wherein at least one additional magnet is at least partially within the second filtration stage.

29. The filtration system of claim 24, wherein the washing operation is any segment of a laundry process chosen from pre-wash, break, carry-over, wash, rinse, or a plurality of rinses.

30. The filtration system of claim 24, wherein the wash mixture comprises water alone, water and a chemical agent, or water and a plurality of chemical agents.

* * * * *